US005298127A

United States Patent [19]

Beran

[11] Patent Number: 5,298,127

[45] Date of Patent: Mar. 29, 1994

[54] PAPER MACHINE DECKLE SUPPORT AND FLUSHING MEANS

[75] Inventor: Robert L. Beran, Covington, Va.

[73] Assignee: Westvaco Corporation, New York, N.Y.

[21] Appl. No.: 965,006

[22] Filed: Oct. 23, 1992

[51] Int. Cl.[5] ..... D21F 1/56

[52] U.S. Cl. ..... 162/353; 162/272; 239/193

[58] Field of Search ..... 162/272, 275, 195, 208, 162/331, 353; 239/193, 548, 566, 518, 520

[56] References Cited

U.S. PATENT DOCUMENTS

| | | | |
|---|---|---|---|
| 2,829,005 | 4/1958 | Broughton | 239/566 |
| 3,405,031 | 10/1968 | Jisson | 162/353 |
| 3,563,854 | 2/1971 | Nisser et al. | 162/353 |
| 3,607,624 | 9/1971 | Moody et al. | 162/272 |
| 3,839,149 | 10/1974 | Beck | 162/353 |
| 4,738,751 | 4/1988 | Newcombe | 162/353 |
| 4,968,387 | 11/1990 | Beran et al. | 162/353 |

FOREIGN PATENT DOCUMENTS

| | | | |
|---|---|---|---|
| 590390 | 1/1978 | U.S.S.R. | 162/353 |

*Primary Examiner*—Karen M. Hastings
*Attorney, Agent, or Firm*—J. R. McDaniel; W. A. Marcontell; R. L. Schmalz

[57] ABSTRACT

A paper machine deckle board is supported and protected from fiber accumulations by a multi-functional structure which adjustably positions the deckle board with an integrated flushing water conduit and film distribution fountain.

3 Claims, 3 Drawing Sheets

PAPER MACHINE DECKLE SUPPORT AND FLUSHING MEANS

BACKGROUND OF THE INVENTION

1. Field of the Invention

The present invention relates generally to fourdrinier paper machines. More specifically, the present invention relates to deckle structures for confining the papermaking stock pond carried on the fourdrinier screen.

2. Description of the Prior Art

Fourdrinier paper machines are characterized by a closed loop web formation screen driven over an open, flat table surface. Extremely dilute, aqueous papermaking stock is jetted upon the traveling screen from a horizontally elongated nozzle; usually associated with a stock accumulation chamber called a headbox.

As the traveling screen carries the stock flow from the slice jet landing zone, aqueous vehicle, i.e., water, drains through the screen to leave the fiber constituent of the papermaking stock accumulated upon the upper screen surface as a consolidated mat.

Between the stock landing zone and that longitudinally displaced point along the screen belt traveling route whereat the mat consolidates into a paper web, the stock is supported on the screen surface as a liquid pond of diminishing depth. Without lateral containment, lateral liquid stock flow cross-directionally sweeps fiber towards the screen sides thereby undesirably tapering the paper web edge thickness.

To prevent such undesirable thickness tapering along the paper web edges, lateral pond confinement structures called "deckle boards" are positioned above and along the screen edges in the machine direction from the slice landing zone. Traditionally, deckle boards are similar to a pair longitudinal dams, each extending along the screen traveling direction respective to each lateral edge of the screen with the screen per se running under the deckle boards.

A more recent innovation to the deckle structure has been to combine the deckle board with a screen edge cupping rail located outboard of the deckle board, as represented by U.S. Pat. No. 4,968,387 to R. L. Beran et al. The curled screen edges, traveling along respective, oppositely cupped rail profiles, hydraulically confine the stock pond. The deckle boards, internally of the cupped rails, are vertically positioned above the screen as to leave a substantial hydraulic channel beneath the lower deckle board edge. Machine white water fills the flow channel between the cupping rail and the outside surface of the deckle board. The inside faces of the deckle boards delineate the outer edge limits of the stock fiber. Standing waves generated in the stock pond are permitted to pass under the deckle board into white water channel and dissipate up the edge cup profile without reflection.

All deckle structure, whether of the traditional design or that using cupped rails, is positioned within close proximity of the energetically traveling stock pond. The structure is located within a virtual mist of fiber particles being continuously splashed from the traveling stock pond. These fiber particles have a high adhesive affinity for any solid surface such as is offered by the deckle structure. Fiber coatings continue to accumulate and soon begin to flake off in agglomerated chunks and fall into the fresh stock pond for web processing. Such web integrated chunks of agglomerated old fiber disrupt the web quality and runnability.

Although the prior art, as represented by U.S. Pat. No. 3,607,624 to W. R. Moody, has partially recognized the value of protecting the deckle structure with a continuously flowing water film, that recognition did not teach a functional structure that would adequately accomplish the objective. Many portions of the Moody structure are not water film flushed and are fiber accumulation surfaces.

Moreover, the deckle adjustment mechanism is clumsy and difficult to set. Additionally, the entire assembly is cluttered with abrupt surfaces and edges.

SUMMARY OF THE INVENTION

It is, therefore, an object of the present invention to provide a deckle board configuration wherein virtually all external surfaces of the assembly are continuously water-flushed.

Another object of the invention is to provide a deckle board support structure having a flushing film distribution fountain for uniformly distributing surface flushing water over the exposed deckle board surfaces.

Another object of the invention is to reduce the magnitude of accessory structure, piping and, generally, clutter around the paper machine forming section.

Another objective of the invention is to provide a deckle board flushing fountain manifold having an adjustable supply pressure for uniform fountain flow.

Another object of the invention is to provide a deckle board flushing fountain that may be internally purged with reverse flushing flow in either direction.

Another object of the invention is to provide a conveniently operated deckle board position adjustment mechanism.

Another object of the present invention is to provide a deckle board flushing means having no dead zones or exposed, dry surface areas.

These and other objects of the invention are accomplished by a U or D shaped support frame respective to each deckle board section. The deckle board is suspended from the bight section of the support. Both arms of the support are secured to respective orthogonal adjusting pedestals. In cross-section, the deckle support frame is of square or rectangular structural tubing adapted to receive fluid supply in the proximity of both deckle support arms.

To the support frame bight section top surface is secured a narrow upstanding blade of flow barrier down the mid-line. On either side of the flow barrier is a row of apertures penetrating the tube wall. Deckle board flushing water supplied from the deckle support arms gently emerges through the top surface apertures for film flow over the top surface edges and down over the deckle board side surfaces.

DESCRIPTION OF THE DRAWINGS

Relative to the drawings wherein like reference characters designate like or similar elements throughout the several figures of the drawings.

DESCRIPTION OF THE PREFERRED EMBODIMENT

Figure 1:
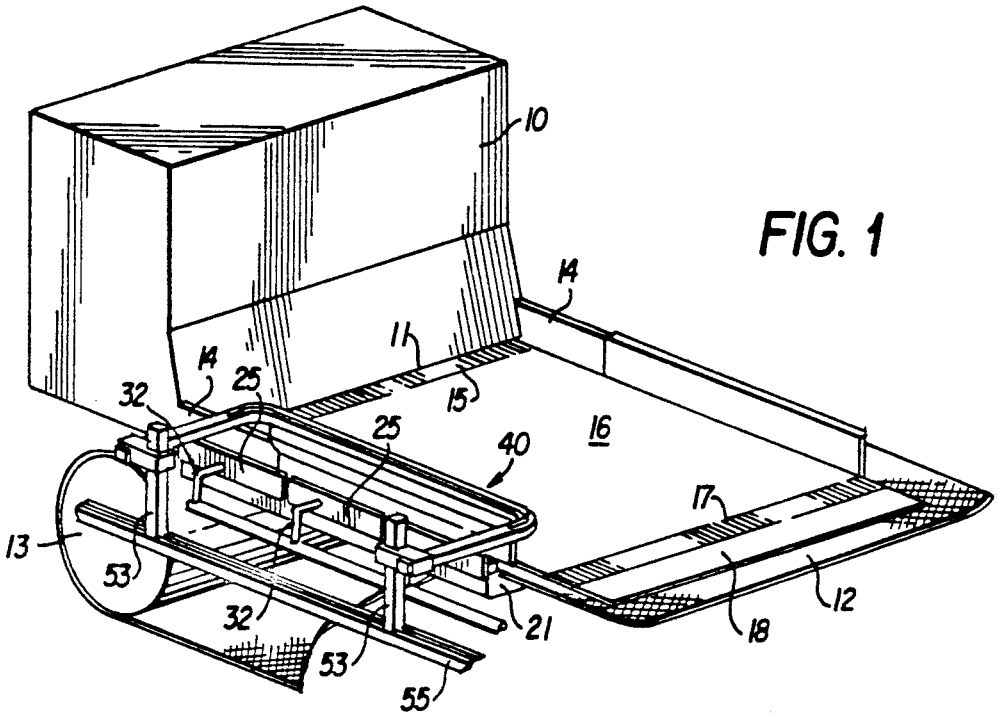
FIG. 1 is an abbreviated pictorial of a paper machine headbox section showing the present invention operatively combined therewith.

For environmental setting, FIG. 1 illustrates the relevant elements of a fourdrinier paper machine as comprising a headbox 10 which discharges dilute, aqueous papermaking stock from a slice opening 11 onto a horizontally carried, table segment of an endless belt screen 12. The screen is turned about and drawn from a breast roll 13 under headbox 10. Extensions 14 from the slice end wall, characterized as "pond sides" or "cheeking pieces," confine the fluid stock beyond the plane of discharge from the slice and may include the line of stock landing 15.

Dynamically, the jet of fluid stock lands upon the screen 12 which is moving at approximately the same horizontal velocity as the stock jet. Although drainage of the stock aqueous vehicle begins immediately, the initial drainage process continues for several seconds during which the stock remains as a highly fluidized pond 16. As this pond is carried away from the slice opening 11, water removal diminishes the pond depth until sufficient free water is removed to form a consolidated fibrous mat 18. That point of mat consolidation is observed on the paper machine as a "dry line" zone 17. Thus formed, the mat is further dried by pressure and heat to an integral, continuous paper web.

In transit, the pond 16 is laterally confined by deckle structure such as the screen edge cupping rail assembly and the deckle board assembly 40.

The screen edge cupping rail assembly comprises the rail element 21 having a concave inside surface 22 for supporting a lateral edge of the traveling screen 12. The "inside" orientation refers to the rail side most proximate of the screen 12 and the stock pond 16.

The top of rail 21 is crowned with a plurality of flushing fountain sections 23, each about 18 to 24 inches long. Each fountain section comprises a square or rectangular section fluid conduit 24 and a side plate 25. The fluid conduit 24 provides a flat top surface penetrated by a row of holes between the upwardly projected inside surface of side plate 25 and the weir edge of the top surface. Flushing fluid is supplied through independent conduits 32. Holes 27 may have an alternating bore axis oritentation with the axis of odd holes aligned at substantially 0° with vertical and the axis of even holes set at an angle of 15° to 45° from vertical toward the top surface weir edge.

The lower projected surface of side plate 25 provides a mounting clamp and alignment fence whereby the fountain section 23 may be secured to the rail element 21.

Figure 3:
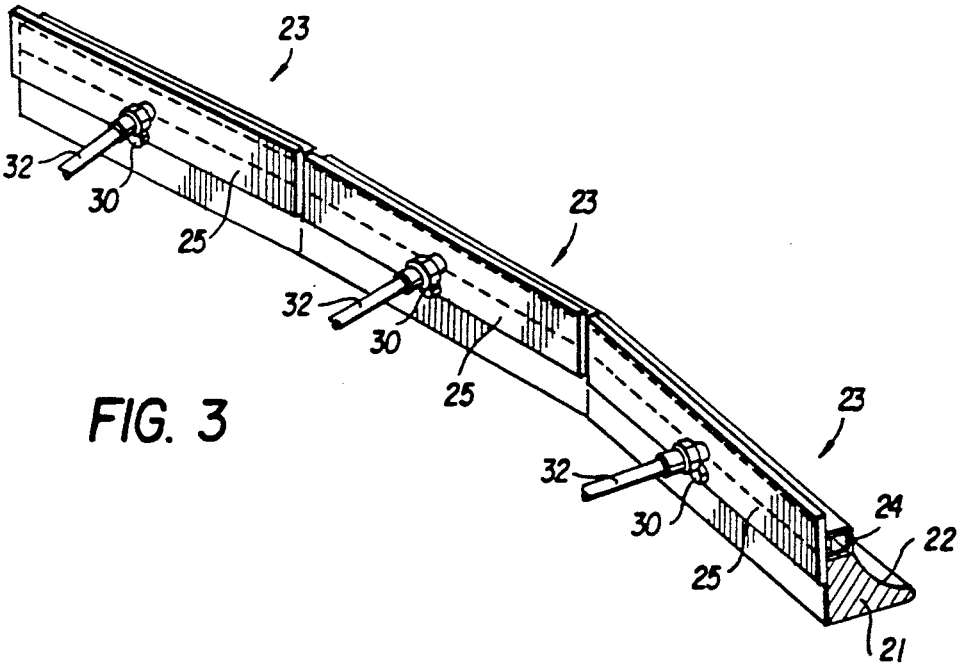
FIG. 3 is a detail of a screen edge cupping rail and flushing fountain.

To obtain minute adjustments of the screen 12 travel profile, the edge cupping rail 21 is often secured to the paper machine forming table in a twisted and warped configuration as suggested by FIG. 3. If continuous along the length of rail 21, the rigidity of the flushing fountain conduit 24 and side plate 25 would prohibit such desired twisting of rail 21 when firmly secured thereto. However, by serving the rail assembly with short sections of flushing fountain 23, such twisting may be accommodated. For this reason, each fountain section 23 is secured by only one cap screw 30 through an oversized aperture 31 in the plate 25. By this means, small differences in the attachment angle betwen each fountain section 23 and a respective increment of the rail may be accommodated. Other, more elaborate, adjustable anchoring mechanisms may be applied to this structural unit but the single cap screw 30 is adequate, simple and inexpensive.

Figure 2:
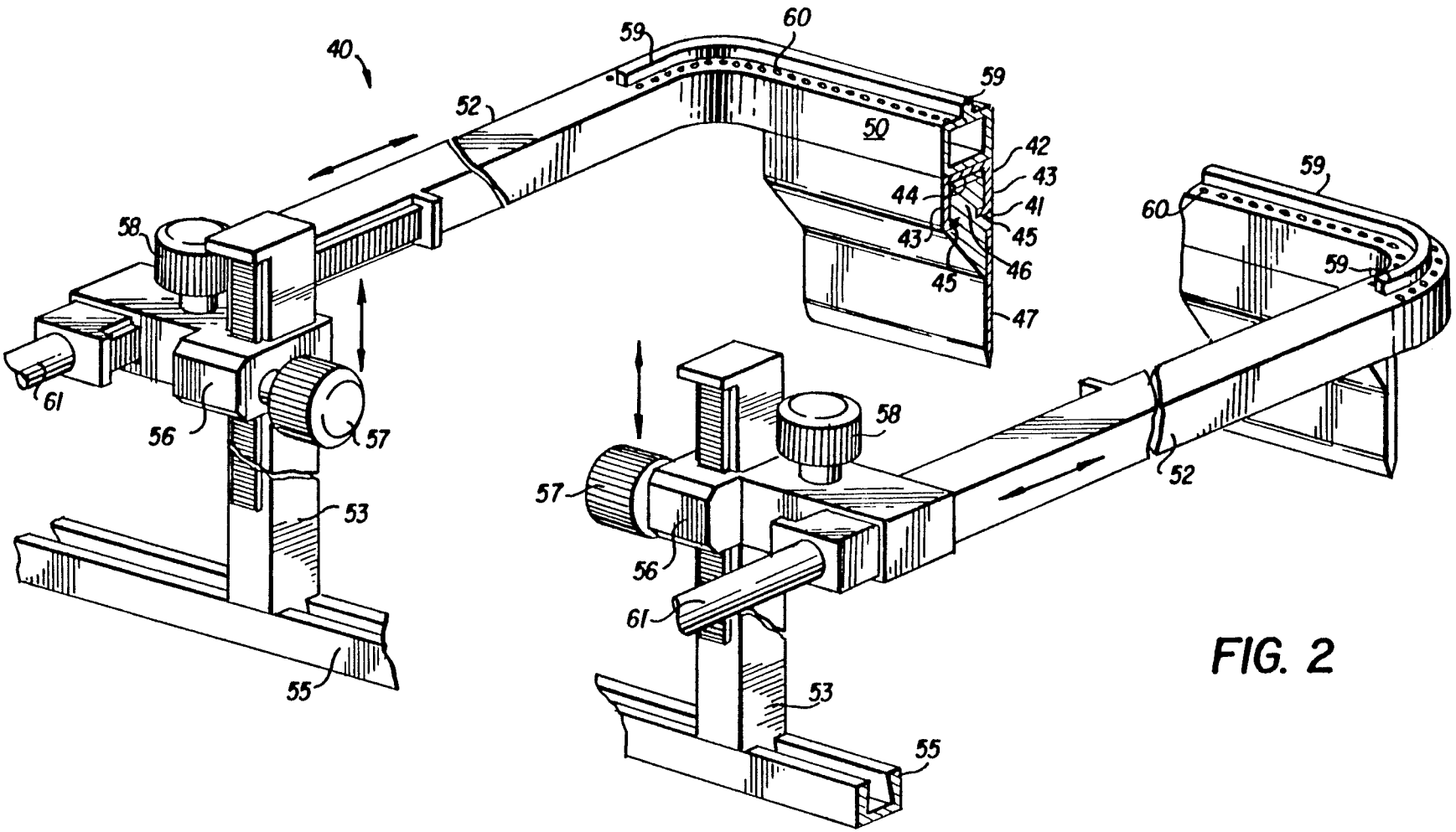
FIG. 2 is an abbreviated pictorial of an integrated flushing fountain and deckle board support.
Figure 4:
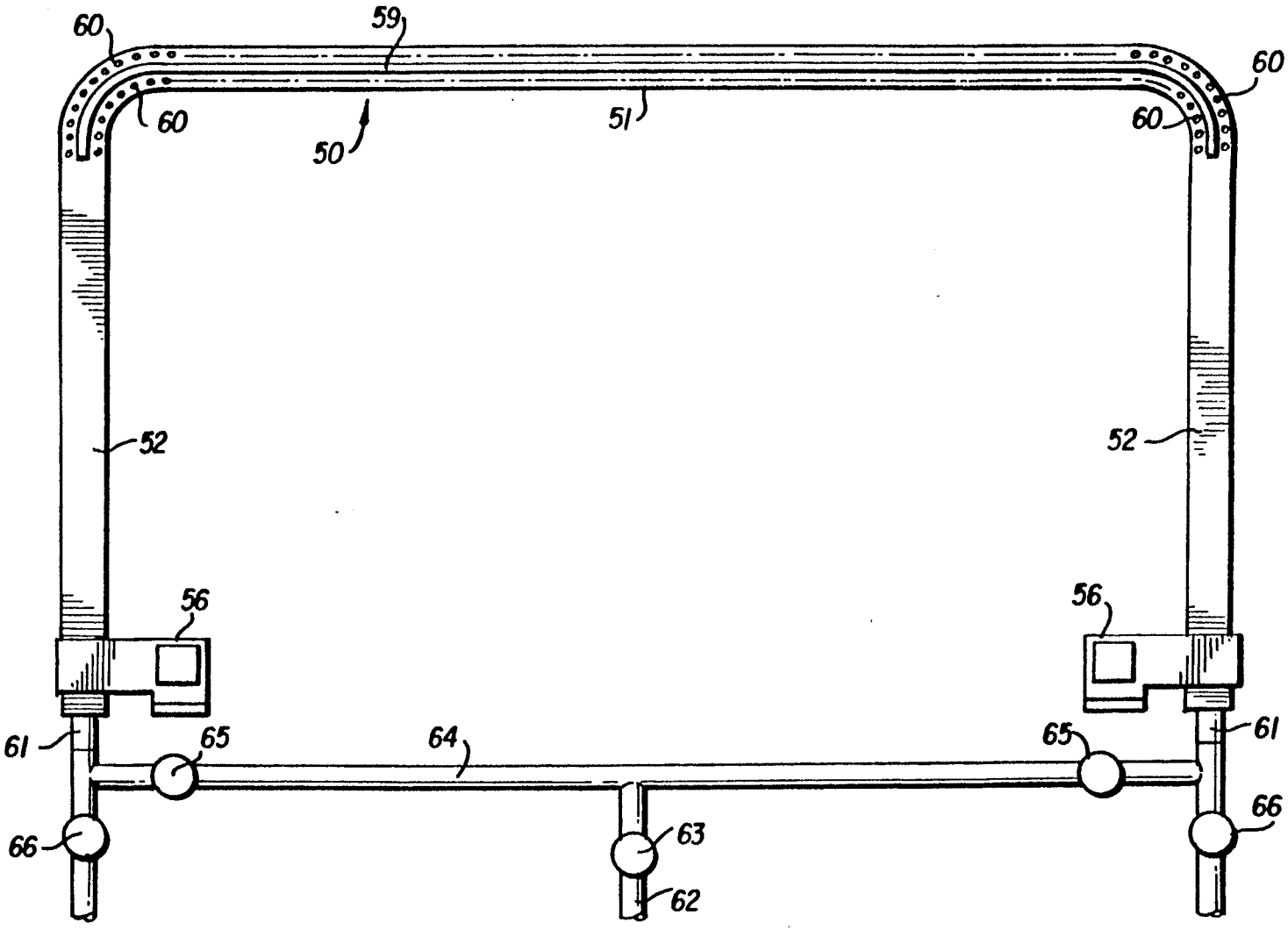
FIG. 4 is an abbreviated pictorial of a deckle board embodiment of the present invention flushing film distribution fountain.

The deckle board assembly of the present invention, shown in detail by FIGS. 2 and 4, comprises a blade unit 41. This blade unit sub-assembly includes a square section C-clip 42 characterized by a pair of support legs 43 depending normally from a bight section 44. A pair of guide rails 45 oppose each other at the distal ends of the support legs.

A blade body 46 formed of a tough, machineable plastic such as Plexiglas (polymethylmethacrylate) is given a pair of channels that are dimensionally compatible with the guide rails 45 for a sliding fit between the guide rails from one end of the unit. Below the guide rails on the inside face (toward the pond 16), the blade body is given a stepped recess to smoothly receive the thickness of a thin, Lexan (polycarbonate) blade 47. The blade 47 is secured to the body recess by a bonding substance such as methylchloride or cyanoacrylic.

C-clip 42 is supported by the bight section 51 of a D-shaped beam 50. In cross-section, the D-shaped beam is square or rectangular butting suitable for fluid stream carriage. Both arm sections 52 of the D-beam are supported from the paper machine accessory frame 55 by pedestals 53. Orthagonal positioning mechanisms 56 manipulated manually by machine wheels 57 and 58 are used to adjust the deckle blade 47 to the required position and hold it there.

Along the D-beam bight section top-side is an upstanding fluid barrier 59. On both sides of the fluid barrier 59 is a row of fluid apertures 60 through the top side tubing wall. Representatively, these apertures are 1/16 inch in diameter spaced ¼ inch apart. Fluid distribution is improved by alternating the bore axis of successive axes from 0° (vertical) to a range of 15° to 45° from vertical.

Functionally, a gentle fountain flow of deckle flushing fluid, i.e. filtered white water, emerges from the apertures 60 and flows as a film over the top-side weir edges. This flowing film substantially coats all surfaces of the blade unit with a protective film of water.

Such protective fluid is supplied to the deckle board through pipe couplings 61 at the ends of the D-beam arm sections 52. Primary supply piping may include a source conduit 62 controlled by a valve 63. Shunt conduit 64 directs the fluid toward both arm 52 and valves 65 are useful to trim and balance the flow rate to respective arms 52. Valves 66 are used for system purging or closed circulation control.

Among the numerous attributes of the present invention are included reduction of equipment clutter in the crowded fourdrinier section of the paper machine. Threaded fastener secured brackets supporting prior art deckle boards are virtually impossible and extremely hazardous to adjust while the respective paper machine is running. By this invention, the deckle board position and alignment may be conveniently and safely adjusted without the use of tools most advantageously, while the machine is running.

Discrete manipulation of the supply and purge valves 65 and 66 allows supply or purge flow from one, both or either end of the fountain bight section 51, an advantage arising from the fact that even filtered white water contains fibrous particles that will in time obstruct the apertures 60 and require rodding and flushing.

A particular advantage to the present invention is the clean structural line between the flushing fountain source 60 and the deckle blade 47. A uniform, flowing, fluid film may be maintained from top to bottom. No abrupt bracket structure is present to interrupt the film flow. Although not illustrated, spray apertures may be provided on the underside of the D-beam 50 to direct a fluid flow against the ends of the C-clip 42 and blade body 46. By eliminating support brackets and using the flushing fountain supply conduit as the structural support for the entire deckle board assembly, the total deckle board surface area is capable of being continuously flooded by a water film. In the preferred embodiment of the invention, the D-shaped beam 50 is formed from straight, square tubing with close radius corners. This construction provides an internally inaccessible bight section 51. However, because of the relatively large internal section area of the beam conduit, such inaccessibility is of no consequence. Should complete mechanical accessibility be required to the bight section 51 or arms 52 internal surfaces, couplings sealed by threaded plugs may be welded to the D-shaped beam corners.

Numerous alternative and mechanically equivalent design configurations may be devised for particular invention features. For example, the deckle blade 47 may be inserted into a central slot along the blade body 46 with both sides tapered fairly into the deckle blade side planes.

As my invention, however, I claim:

1. A paper machine deckle means comprising elongated deckle board assembly structurally unitized with flushing fountain means, said fountain means comprising elongated fluid manifold having opposite ends operatively connected to respective, structurally supportive flu conduits, said fluid conduits being transversely projected from sa elongated fluid manifold, said fluid manifold and said fluid conduits being respective segments of a singular, integrated flow channel, said fluid manifold being structured to distribute a fluid film to flush external surfaces of said deckle board assembly, and means for adjustably securing each said fluid conduit segment to a frame means points remote from said manifold whereby said deckle board assem is positionally adjusted relative to said frame means positionally adjusting said fluid conduit segments at said remote points.

2. The deckle means as described by claim 1 wherein said flow channel is an integral length of a substantially square section tube with said fluid conduit segments extending substantially normally from said manifold segment.

3. The deckle means as described by claim 2 wherein said flushing fountain means further comprises a multiplicity of apertures penetrating an uppermost, horizontal, planar wall of said square section tube within said manifold segment and structured so that fluid emerging through said apertures from within said manifold is required to flow over an adjacent horizontal edge of said uppermost planar wall for distribution over said deckle board assembly external surfaces.

* * * * *

UNITED STATES PATENT AND TRADEMARK OFFICE

CERTIFICATE OF CORRECTION

PATENT NO. : 5,298,127

DATED : Mar. 29, 1994

INVENTOR(S) : Robert L. Beran

It is certified that error appears in the above-indentified patent and that said Letters Patent is hereby corrected as shown below:

Column 6, line 7, (Claim 1, line 7) delete "sa", insert --said--. Column 6, line 13, (Claim 1, line 13) following "means" insert --at--.

Signed and Sealed this

Twenty-sixth Day of July, 1994

*Attest:*

Bruce Lehman

BRUCE LEHMAN

*Attesting Officer*

*Commissioner of Patents and Trademarks*